US006888070B1

(12) United States Patent
Prescott

(10) Patent No.: US 6,888,070 B1
(45) Date of Patent: May 3, 2005

(54) CABLES INCLUDING FILLERS

(75) Inventor: Stephen John Prescott, Chorley (GB)

(73) Assignee: Raydex/CDT Limited, Skelmersdale (GB)

( * ) Notice: Subject to any disclaimer, the term of this patent is extended or adjusted under 35 U.S.C. 154(b) by 0 days.

(21) Appl. No.: 10/110,878

(22) PCT Filed: Oct. 16, 2000

(86) PCT No.: PCT/GB00/03956

§ 371 (c)(1),
(2), (4) Date: Sep. 5, 2002

(87) PCT Pub. No.: WO01/29848

PCT Pub. Date: Apr. 26, 2001

(30) Foreign Application Priority Data

Oct. 16, 1999 (GB) ..... 9924411

(51) Int. Cl.[7] ..... H01B 11/00
(52) U.S. Cl. ..... 174/113 C; 174/131 A
(58) Field of Search ..... 174/113 R, 113 C, 174/131 A

(56) References Cited

U.S. PATENT DOCUMENTS

| | | | | |
|---|---|---|---|---|
| 3,055,967 A | | 9/1962 | Bondon | 174/28 |
| RE32,225 E | * | 8/1986 | Neuroth | 174/103 |
| 4,828,352 A | * | 5/1989 | Kraft | 385/109 |
| 5,789,711 A | | 8/1998 | Gaeris et al. | |
| 5,952,615 A | * | 9/1999 | Prudhon | 174/113 C |
| 5,969,295 A | | 10/1999 | Boucino et al. | |
| 6,074,503 A | | 6/2000 | Clark et al. | |
| 6,300,573 B1 | | 10/2001 | Horie et al. | |
| 6,596,944 B1 | | 7/2003 | Clark et al. | |

FOREIGN PATENT DOCUMENTS

| | | |
|---|---|---|
| DE | 697378 | * 10/1940 |
| DE | 3708216 | 9/1988 |
| EP | 0763831 A1 | 3/1997 |
| EP | 0803877 A2 | 10/1997 |
| GB | 2157477 A | 10/1985 |
| GB | 2241107 A | 8/1991 |

* cited by examiner

*Primary Examiner*—Chau N. Nguyen
(74) *Attorney, Agent, or Firm*—Lowrie, Lando & Anastasi, LLP

(57) ABSTRACT

A cable includes a filler (12) including a plurality of points of weakness (13) or discontinuities spaced along its length. The points of weakness or discontinuities may be evenly spaced along the length of the cable and may be formed by partially or fully cutting through the filler. The filler may be formed from a plastics material and may be shaped, in cross section, to have a number of arms to enable it to separate other components of the cable. The filler may be electrically conducive or semi-conductive to enable it to act as screen between other components of the cable.

29 Claims, 5 Drawing Sheets

CABLES INCLUDING FILLERS

RELATED APPLICATIONS

Foreign priority benefits are claimed under 35 U.S.C. §119(a)–(d) or 35 U.S.C. §365(b) of United Kingdom application number 9924411.3, filed Oct. 16, 1999.

BACKGROUND OF INVENTION

1. Field of Invention

The present invention relates to cables including fillers.

2. Discussion of Related Art

It is common for electrical and optical cables to include a filler or multiple fillers. Fillers typically comprise string or extruded plastic components which occupy space within the cable. They may be provided to enhance the overall shape of and/or positioning of other components, for example conductors or optical fibers, relative to each other within the cable, or to provide mechanical protection. For example, a central filler may be surrounded by cable components, or interstitial fillers may be provided between cable components to give a cable a substantially circular cross section.

Where a cable is terminated, for example in a connecting device, the filler is normally redundant or superfluous. In many cases, the filler is of nuisance value to the installer who has to perform what is perceived as the extra task of removing it prior to terminating the cable. In some cable and connector designs where space limitation, connection procedures, or specific performance requirements dictate, the task can be difficult to achieve satisfactory and/or safely.

The problem of filler removal is particularly acute with the type of cables used for high speed data transmission. One design of cable employs four pairs of twisted insulated copper wires surrounding an extruded plastic filler element of cross-shaped cross-section. The filler serves to separate the twisted pairs to reduce the amount of signal interference ("crosstalk") between them. Crosstalk is also reduced by careful selection of a different twist pitch for each element. The twisted pairs and filler are surrounded by an outer sheath.

Such cable is typically terminated in small connectors such as the industry standard RJ45-type. Making an interface between cable and connector requires great care by the installer to ensure that components combine in an effective manner to give a high performance connection. To achieve this some of the cable sheath must be removed to expose the wires, and the filler removed to the point of the cable sheath so that it does not interfere with the termination procedure or quality. To achieve this, the twisted pairs need to be displaced or folded back so that the filler can be cut.

This procedure has two major drawbacks. Firstly, the construction of the twisted pair is extremely precise in all respects. Disturbing the integrity of the twisted pair by displacement, bending, untwisting or other mechanical disturbance, may reduce cable performance significantly and irreparably. Secondly, installation engineers wish to minimize the number of steps and the time involved in each termination, and removal of such components can be awkward, time consuming and therefore costly.

SUMMARY OF INVENTION

It is an object of the present invention to reduce the problems associated with conventional cables incorporating fillers, especially cables used for high speed data transmission.

According to a first aspect of the present invention there is provided a cable comprising a filler having a plurality of points of weakness or discontinuities spaced along its length.

The provision of points of weakness or discontinuities enables a portion of filler to be removed from the cable without the need for cutting. To remove a portion the filler is placed under tension, for example by pulling with finger and thumb or pliers. The filler can then be withdrawn from the cable up to the nearest discontinuity or point of weakness at which the filler will preferentially break. Since sharp tools are not required there is a reduced risk of accidental cable damage and personal injury.

It is preferred that the points of weakness or discontinuities are evenly spaced. The spacing may be made consistent with the intended requirements for connectorizing or terminating a particular cable. The spacing may also be consistent with avoiding signal reflections in the operating frequency range. In one embodiment the points of weakness or discontinuities lie at intervals of between 10 and 50 mm.

The outside of the cable may be marked to indicate the locations of the points of weakness or discontinuities in the filler.

Points of weakness may be formed by partially cutting through the filler. In one arrangement points of weakness are formed by perforating the filler. Points of weakness could also be formed by varying the cross-section or composition of the filler or strength of the filler in some other way, for example, during extrusion of a plastic filler.

Preferably, the filler is formed from plastics material. Suitable non-electrically conductive materials include polyethylene, polypropylene and PVC. Such a filler may be formed by extrusion. The filler is preferably disposed to separate two or more cable components. Preferably the filler is shaped, in cross-section, to have a number of arms, for example, four, to form a cross shape to enable it to separate other cable components. The filler is preferably flexible.

The cable preferably comprises a plurality of cable components.

Preferably, the cable components comprise a plurality of twisted pairs of insulated wires and each pair is separated from each other pair by the filler. The number of pairs of wires preferably corresponds to the number of arms of the filler.

Separating the pairs of wires helps to reduce the amount of crosstalk between them. To further reduce crosstalk an electromagnetic screen may be provided around one or more of the pairs for example by wrapping the pair with a conductive tape, for example, a metal tape or tape laminate. An aluminium/polyester laminate would be suitable.

As an alternative, or to further reduce crosstalk, a further preferred feature of the invention is that the filler comprises some electrically conductive or semi-conductive material. This enables the filler to act as an electromagnetic screen. The filler is preferably formed from a conductive plastics material, for example a semi-conductive polymer.

The filler may be formed from a foamed material.

The cable filler and components are preferably disposed within an outer sheath. They may also be surrounded by tapes, foils, laminates, braids and other components, for electromagnetic screening or mechanical protection.

The invention provides for the production of cables for high speed data transmission which may be more quickly, easily, safely and reliably installed than conventional cables.

According to a second aspect of the present invention there is provided a method of manufacture of a cable comprising the steps of providing a filler and partially or wholly cutting through the filler at points along its length to form points of weakness or discontinuities along its length.

Preferably, the method also comprises the step of encapsulating the filler together with other cable components in an outer sheath.

According to a third aspect of the present invention there is provided a method of preparing a cable according to the first aspect of the present invention, with or without any of the subsequently discussed optional features of that aspect, for installation, comprising the step of pulling on the filler to remove a portion of the filler up to a point of weakness or discontinuity.

Preferably the filler is removed up to the first point of weakness or discontinuity from the point at which it is pulled. The cable preferably includes an outer sheath and the method preferably further comprises the step of stripping off a portion of the outer sheath to expose a portion of the filler at the end of the cable, which portion can then be pulled to remove a portion of the filler.

BRIEF DESCRIPTION OF DRAWINGS

In order that the invention may be more clearly understood, embodiments thereof will now be described by way of example with reference to the accompanying drawings in which.

DETAILED DESCRIPTION

Figure 1:
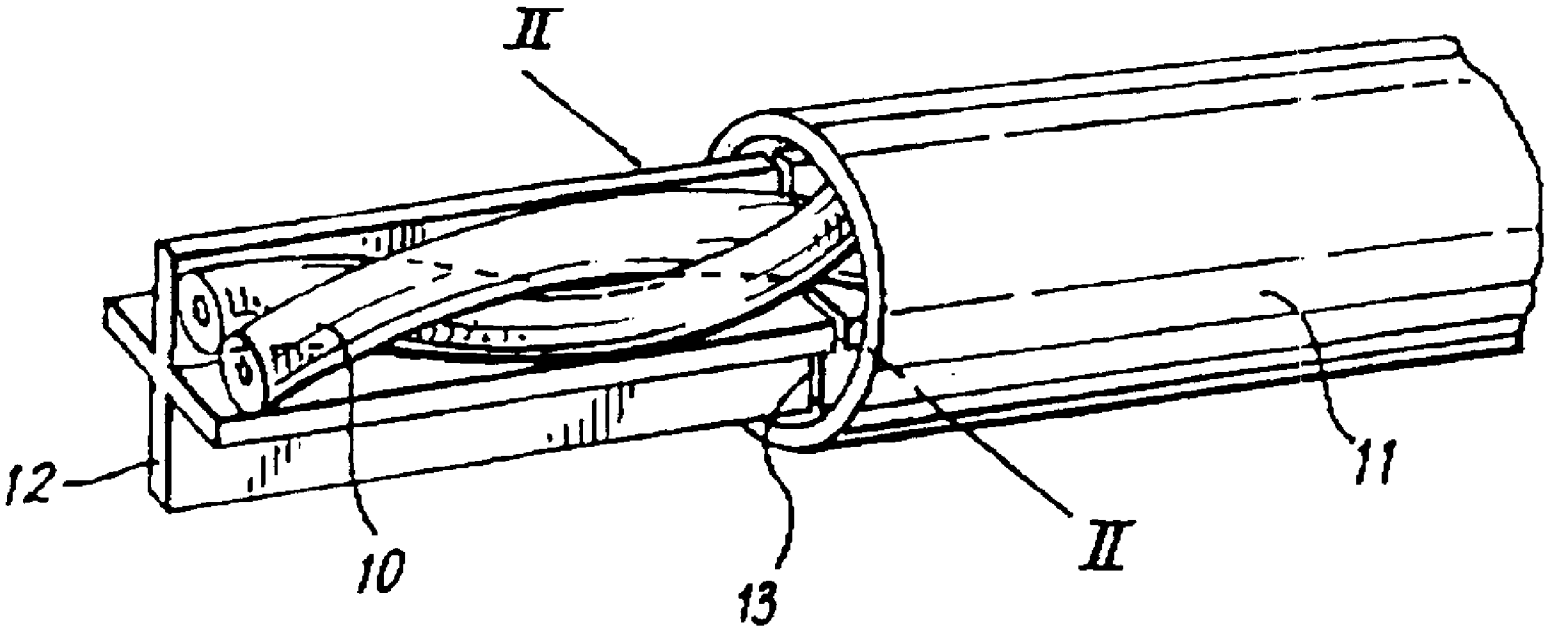
FIG. 1 is a perspective view of one embodiment of a cable according to the invention with part of its outer sheath stripped away to reveal a filler and one of four twisted pairs of cable.
Figure 2:
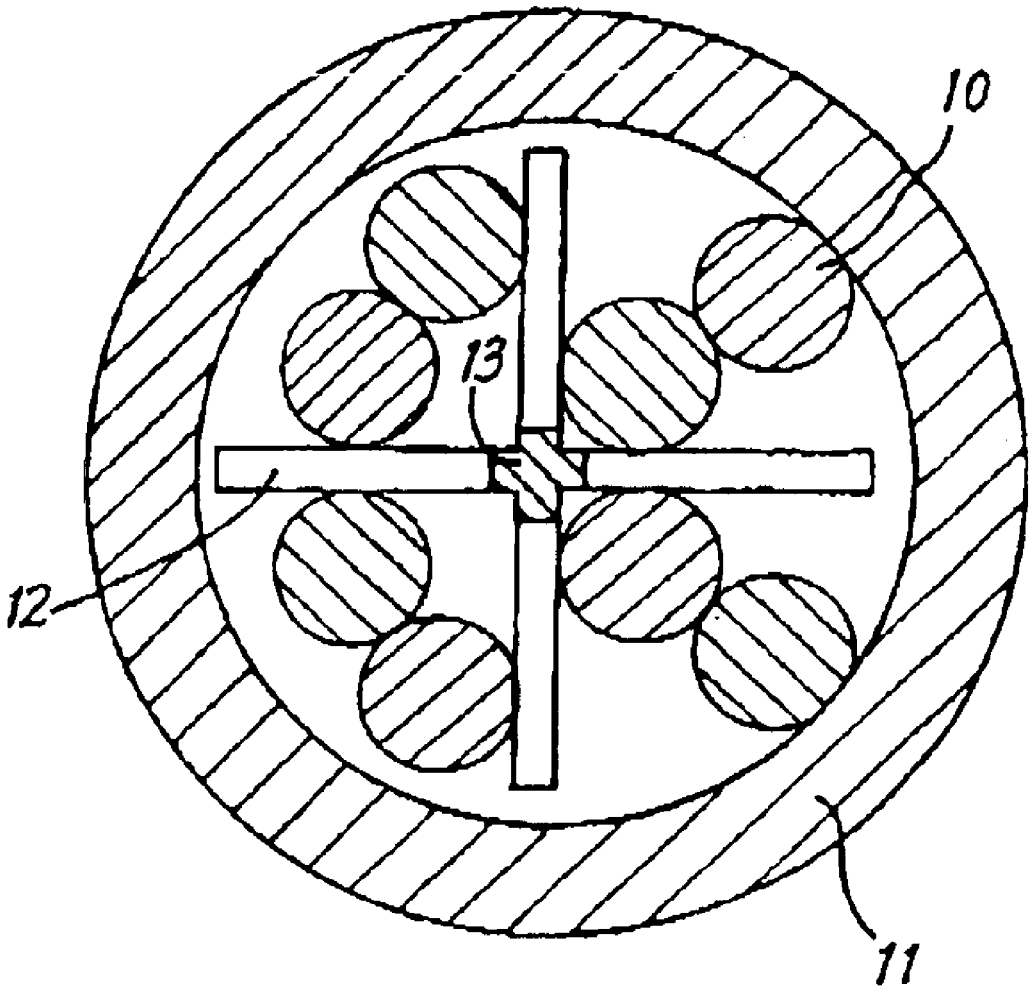
FIG. 2 is a cross-sectional view of the cable of FIG. 1 taken along the line II—II.

Referring to FIGS. 1 and 2, a cable comprises four pairs of twisted insulated electrical wires 10 (only one of which is shown in FIG. 1, for clarity) disposed in a plastic outer sheath 11. Also disposed in the outer sheath 11 is a cable filler 12 comprising an electrical grade polyethylene extrusion the cross section of which is cross-shaped with four substantially perpendicular arms which divide the space within the outer sheath 11 into four regions. The four pairs of wires 10 are respectively disposed in these regions. The filler 12 gives the cable structure as well as separating the four pairs of twisted wires 10 to reduce crosstalk between them.

In an alternative embodiment the filler 12 is formed from an electrically conductive material and therefore provides an electromagnetic screen between each twisted pair. This embodiment is capable of producing extremely low values for crosstalk over a wide frequency bandwidth.

At regular intervals along its length each arm of the filler 12 has been partially cut through to provide a point of weakness 13 at which the filler 12 will preferentially break when placed under tension.

The cable is shown with a portion of its outer sheath 11 removed, to expose the wires 10 to enable them to be fitted into a connector to terminate the cable. To correctly terminate the cable, for example with an industry standard RJ45 connector, to provide a connection which does not impair the performance of the system of which the cable forms part it is necessary to remove the exposed filler 12, back to the sheathed section of cable, but to leave the wires 10 intact.

Conventionally it would be necessary to fold back the twisted wire pairs 10 and cut the filler 12. Disturbing the integrity of the twisted pairs 10 may reduce cable performance significantly, particularly with cables of the illustrated type which can support data transmission of digital information at rates of the order of 1 G bit/s and above. When cutting the filler there is also a risk of damaging the cable.

However, with the illustrated cable all that is required is to grip the end of the filler 12 and pull it away from the cable. The filler 12 will then break at the first point of weakness 13, within the cable sheath 11, without disturbing the wires 10.

The distant between the points of weakness is sufficient so that the filler is accessible so as to facilitate gripping with finger and thumb or small tools.

Figure 3:
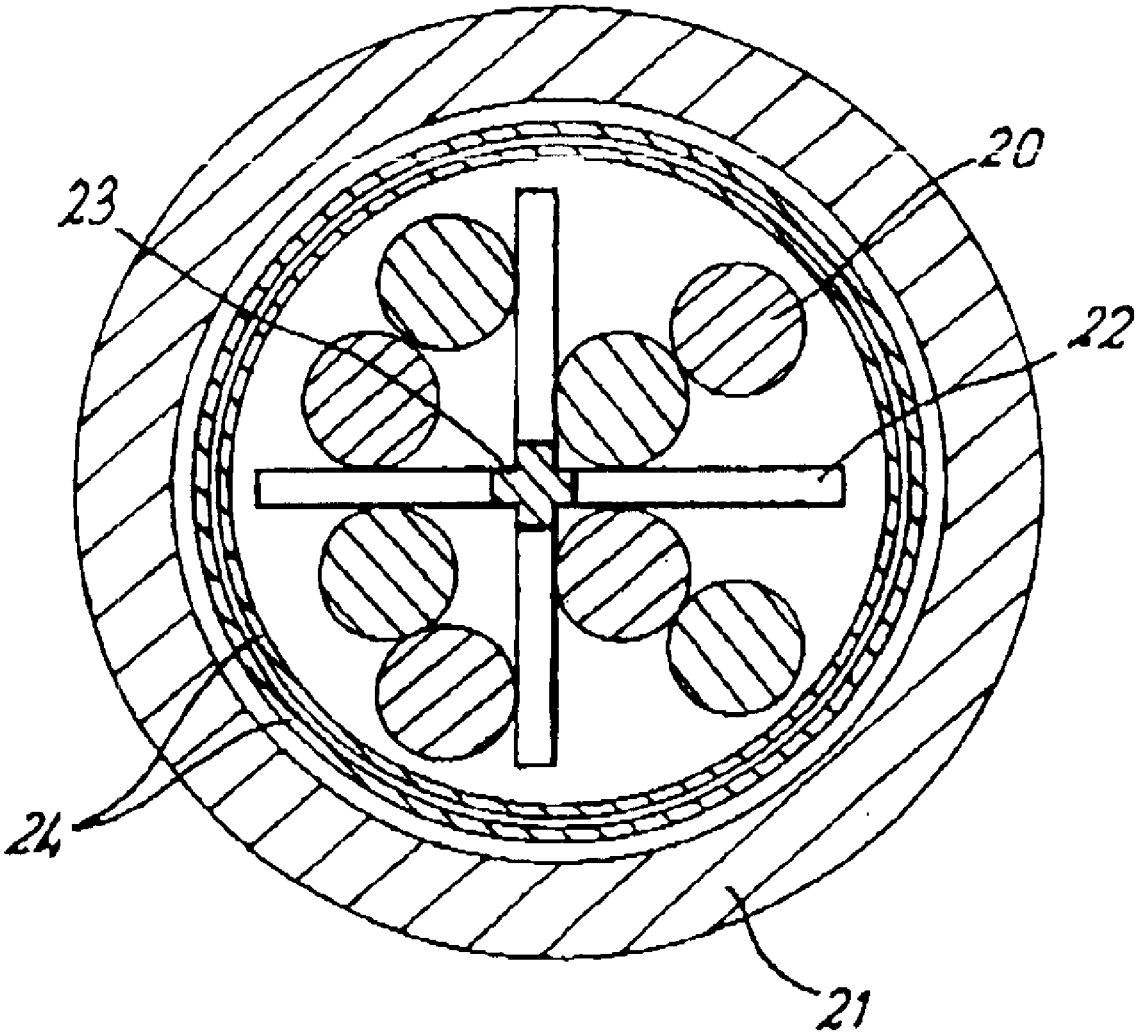
FIG. 3 is a cross-sectional view through another embodiment of a cable according to the invention.

FIG. 3 shows an alternative embodiment. Referring to this Figure, this embodiment is similar to that shown in FIGS. 1 and 2 in that it comprises four pairs of twisted wires 20 and a cross-shaped filler 22 disposed in an outer sheath 21, the filler 22 having points of weakness 23 spaced along its length.

Where this embodiment differs is that it additionally includes two insulating and/or screening layers 24 disposed around the four twisted pairs 20 and filler 22, under the outer sheath 21.

Figure 4:
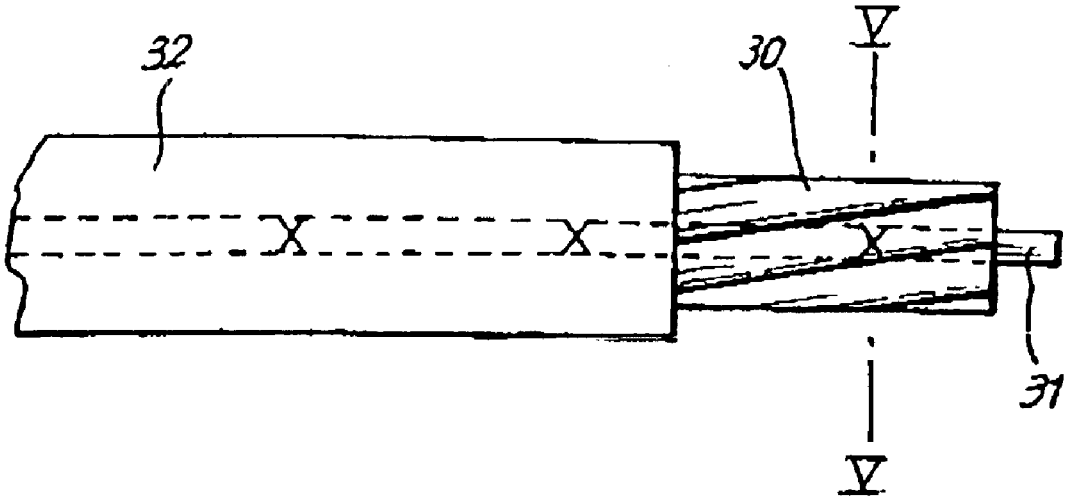
FIG. 4 is a side view of another embodiment of a cable according to the invention with some of its outer sheath stripped away to reveal a filler and cable components.
Figure 5:
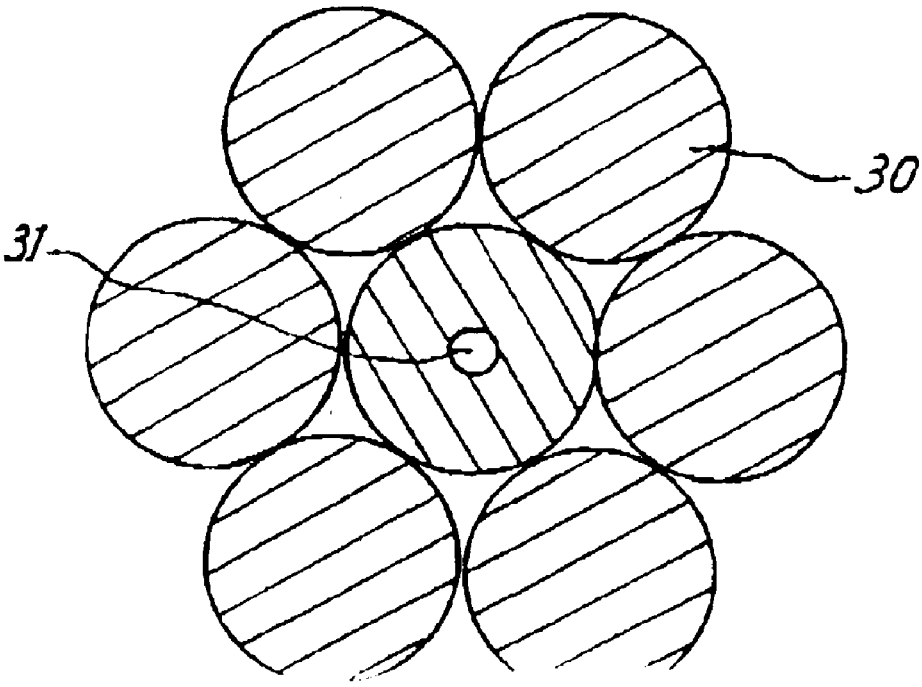
FIG. 5 is an enlarged cross-sectional view of the cable of FIG. 4, taken along the line V—V.

Referring to FIGS. 4 and 5 another embodiment comprises six helically assembled cable components 30, which could be insulated wires, optical fibres or some other component or combination of components, surrounding a central filler 31. The filler could be formed from plastic, string or some other suitable material. The cable components 30 and filler 31 are surrounded by a plastic outer sheath 32.

At regular intervals along the length of the cable points of weakness are formed in the filler 31, at which it will preferentially break when placed under tension. Each point of weakness comprises a region of reduced cross-section, which may be formed by partially cutting through the filler. The location of each point of weakness is indicated by an "X' in FIG. 4. The outer sheath could be marked to show the position of the points of weakness.

The cable is shown with part of the outer sheath 33 removed, to enable the cable components 30 to be terminated. Before doing so excess filler 31 must be removed. This is achieved by pulling the exposed end of the filler 31 away from the cable whereupon it will break at a point of weakness, most probably that nearest the end of the filler.

In all the illustrated embodiments the points of weakness could be replaced with discontinuities in the filler.

Figure 6:
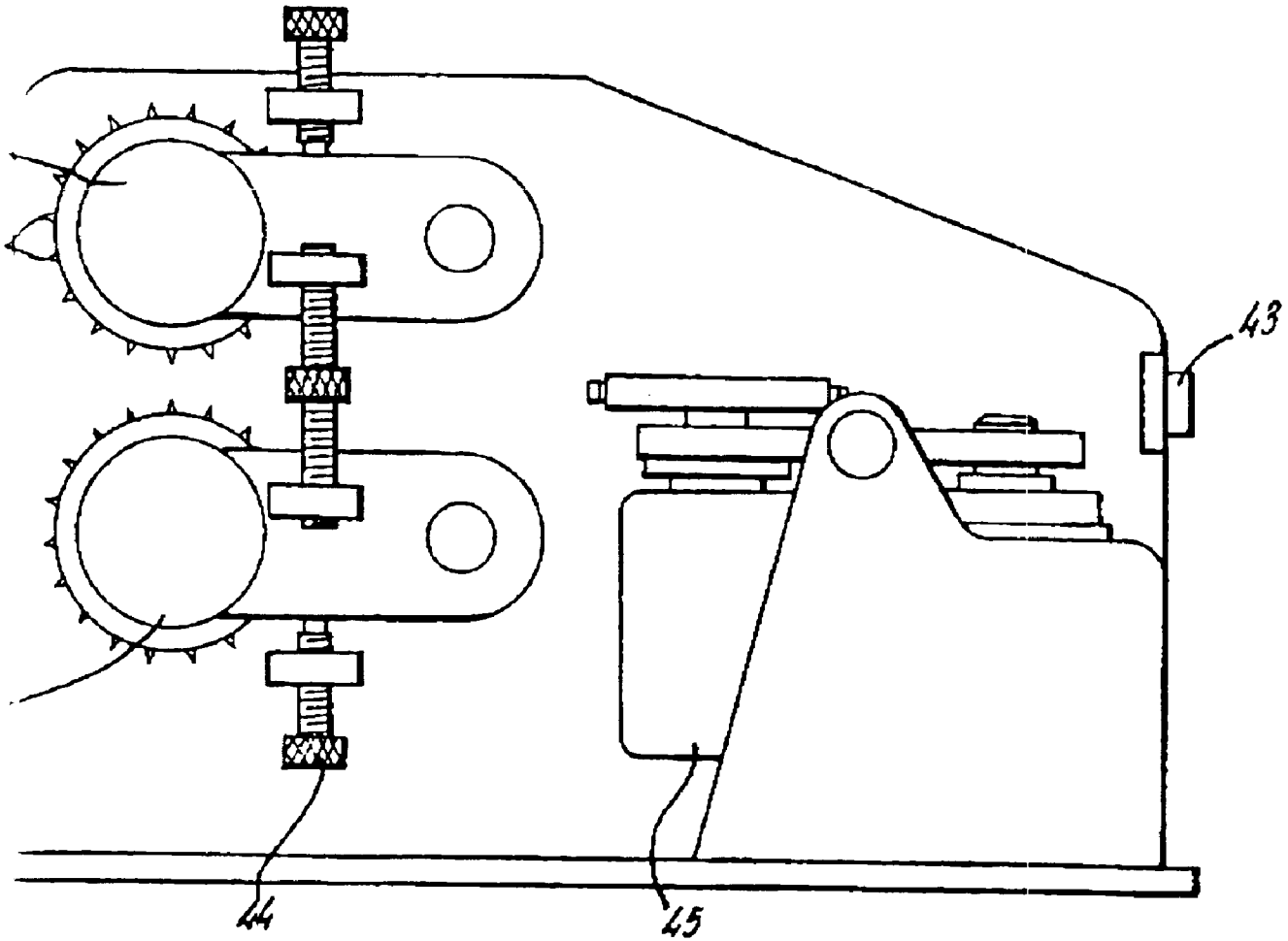
FIG. 6 is a schematic view of apparatus for introducing points of weakness into a cable filler.

FIG. 6 shows apparatus to introduce points of weakness into a cable filler.

Filler enters the apparatus through a die 40 and then proceeds between two sets of wheels 41 with blades 42 disposed around their periphery. The blades 42 will cut into opposite sides respectively of the filler. The two sets of wheels are disposed at right angles to each other, so that upon passing through the apparatus, cuts will be made into the filler from four perpendicular directions. The filler leaves the apparatus through a second die 43.

Provision 44 is made to allow adjustment of the relative position of the cutter wheels.

The blade wheels 41 are driven by servo controlled motors 45 and may be controlled from an encoder driven by the filler as it passes through the machine.

The above embodiments are described by way of example only, many variations are possible without departing from the invention. For example, additional components can be laid under the outer sheath of the cable, for example longitudinal wires to assist earthing/screen connection and/or kevlar string/tape to provide mechanical protection and longitudinal strength. The weaknesses or discontinuities in the filler could be introduced by non-mechanical means, for example, with a laser.

What is claimed is:

1. A cable comprising an outer sheath, a plurality of interior cable components and a filler having a plurality of longitudinally-spaced points of weakness, wherein the filler is constructed to facilitate breaking of the filler under longitudinal tension at any of the plurality of longitudinally spaced points of weakness, and wherein an outside surface of said outer sheath is marked to indicate the locations of said plurality of longitudinally spaced points of weakness.

2. The cable of claim 1 wherein said plurality of longitudinally spaced points of weakness are evenly spaced.

3. The cable of claim 1 wherein said plurality of longitudinally spaced points of weakness are spaced at intervals of between 10 mm and 50 mm.

4. The cable of claim 1 wherein said plurality of longitudinally spaced points of weakness are formed by at least partially cutting through said filler.

5. The cable of claim 1 wherein said plurality of longitudinally spaced points of weakness are formed by perforating the filler.

6. The cable of claim 1 wherein said filler comprises a plastic material.

7. The cable of claim 1 wherein said filler is cross-shaped in cross-section.

8. The cable of claim 1 wherein said filler is at least partially electrically conductive.

9. The cable of claim 1 wherein said interior cable components comprise a plurality of twisted pairs of insulated wire.

10. The cable of claim 1 wherein said interior cable components comprise a plurality of twisted pairs of insulated wire and wherein an electromagnetic screen is provided around at least one of the twisted pairs.

11. The cable of claim 1 wherein the filler is constructed to define at least one slot at each of the plurality of longitudinally spaced points of weakness, the at least one slot extending from an outer edge of at least one arm of the plurality of arms toward a center of the filler; and wherein a depth of the slot is greater than half a height of the at least one arm.

12. A method of manufacture of a cable comprising the steps of:

providing a filler, shaped in cross-section, to have a plurality of arms configured to separate interior cable components; and forming a plurality of points of weakness along a length of the filler that are configured so as to facilitate breaking the filler at the plurality of points of weakness;

wherein the step of forming the plurality of points of weakness includes varying one of a cross-section and a composition of the filler during extrusion of the filler.

13. The method of claim 12 further comprising the step of encapsulating said filler together with said interior cable components within an outer sheath.

14. A cable comprising an outer sheath, and a filler shaped in cross-section to have a plurality of arms configured to separate interior cable components within said sheath, said filler having a plurality of longitudinally spaced points of weakness;

wherein the filler is constructed to facilitate breaking of the filler at any of the plurality of longitudinally spaced points of weakness; and wherein the filler is constructed to define a plurality of slots at each of the plurality of longitudinally spaced points of weakness, the plurality of slots including a first slot formed in a first arm of the plurality of arms and a second slot formed in a second, oppositely located, arm of the plurality of arms, such that the first and second slots are substantially aligned end-to-end.

15. The cable of claim 14 wherein a depth of each of the first and second slots is greater than half of a height of the corresponding first and second arms.

16. The cable of claim 14 wherein the plurality of longitudinally spaced points of weakness are evenly spaced.

17. The cable of claim 14 wherein the plurality of longitudinally spaced points of weakness are spaced at intervals of between 10 mm and 50 mm.

18. The cable of claim 14 wherein an outside surface of the outer sheath is marked to indicate the locations of the plurality of longitudinally spaced points of weakness.

19. The cable of claim 14 wherein the plurality of longitudinally spaced points of weakness are formed by at least partially cutting through the filler.

20. The cable of claim 14 wherein the plurality of longitudinally spaced points of weakness are formed by perforating the filler.

21. The cable of claim 14 wherein the filler comprises a plastic material.

22. The cable of claim 14 wherein the filler is cross-shaped in cross-section.

23. The cable of claim 14 wherein the filler is at least partially electrically conductive.

24. The cable of claim 14 wherein the interior cable components comprise a plurality of twisted pairs of insulated wire.

25. The cable of claim 14 wherein the interior cable components comprise a plurality of twisted pairs of insulated wire and wherein an electromagnetic screen is provided around at least one of the twisted pairs.

26. The cable of claim 14 wherein a depth of the first slot is greater than half a height of the first arm.

27. A method of manufacture of a cable comprising the steps of:

providing a filler shaped in cross-section to have a plurality of arms configured to separate interior cable components; and at least partially cutting through said filler at points along its length to form a plurality of points of weakness along its length that are configured so as to facilitate breaking the filler at the plurality of points of weakness;

wherein the step of at least partially cutting through the filler includes cutting a first slot into a first arm of the plurality of arms and cutting a second slot into a second, oppositely located, arm of the plurality of arms, such that the first and second slots are substantially aligned end-to-end.

28. The method of claim 27 wherein the step of at least partially cutting through the filler includes cutting the first slot into the first arm to a depth of greater than half a height of the first arm.

29. The method of claim 27 further comprising the step of encapsulating the filler together with the interior cable components within an outer sheath.

* * * * *